United States Patent [19]

Fawkes

[11] Patent Number: 4,956,892

[45] Date of Patent: Sep. 18, 1990

[54] CORDLESS VACUUM BRUSH

[76] Inventor: Donald G. Fawkes, 1000 S. Illinois, #1006, Mason City, Iowa 50401

[21] Appl. No.: 346,691

[22] Filed: May 3, 1989

[51] Int. Cl.[5] ..... A47L 5/24

[52] U.S. Cl. ..... 15/339; 15/344; 15/398; 15/410; 15/416; 15/415.1

[58] Field of Search ..... 15/339, 344, 410, 398, 15/400, 415 R, 416, 417

[56] References Cited

U.S. PATENT DOCUMENTS

| | | | |
|---|---|---|---|
| 2,999,263 | 9/1961 | Smith | 15/344 |
| 3,308,498 | 3/1967 | Evans, Jr. | 15/23 |
| 3,477,087 | 11/1969 | Robinson | 15/344 |
| 3,903,564 | 9/1975 | Morinaga | 15/344 |
| 3,952,239 | 4/1976 | Owings et al. | 200/332.2 X |
| 4,011,624 | 3/1977 | Proett | 15/344 |
| 4,542,557 | 9/1985 | Levine | 15/344 |
| 4,573,234 | 3/1986 | Kochte et al. | 15/344 X |
| 4,573,237 | 3/1986 | Kochte et al. | 15/344 X |
| 4,688,294 | 8/1987 | Simonsson | 15/417 |
| 4,734,017 | 5/1988 | Levin | 15/344 X |

*Primary Examiner*—Chris K. Moore
*Attorney, Agent, or Firm*—Morton S. Adler

[57] ABSTRACT

A cordless vacuum brush includes a forward vacuum assembly containing a motor, fan, a dust trap and a rearward elongated hollow handle assembly containing a plurality of battery cells connected in series for operating the motor and a built-in battery charger. The rear or free end of the handle assembly is equipped with an endcap having a fold-out connector or plug for plugging into an 120 volt AC outlet. The handle assembly is detachably secured to the vacuum assembly so that it can be removed for charging the batteries and when attached to an electrical wall outlet will hang straight down therefrom. A generally rectangular flat elongated brush head with a hollow interior and peripheral depending soft, pliable bristles includes means for flexibility of movement relative to the vacuum assembly so that it does not have to be held or operated at any fixed angular orientation relative to the surface being dusted and is also designed for orientation either transverse to the longitudinal axis of this device for general use or endwise in alignment with such axis for insertion into confined areas. The swing joint component is spring loaded and biased to restore the brush to longitudinal alignment. A switch is provided to allow momentary or continuous operation and with the availability of a spare handle assembly, the operating time for this device can be indefinite by interchanging such assemblies when necessary. The batteries are easily replaceable to provide indefinite running time with a single handle assembly.

23 Claims, 3 Drawing Sheets

CORDLESS VACUUM BRUSH

BACKGROUND OF THE INVENTION

This invention relates to improvements in vacuuming devices and more particularly to an electrically operated portable cordless vacuum brush designed to remove from various surfaces particulate matter generally having the consistency of talcum powder.

Portable electrical vacuuming devices requiring in some cases an electric cord for attachment to a power source and in other cases having rechargeable batteries are disclosed in the prior art for a variety of purposes including brushes for clothes, hair, dandruff and for general vacuum cleaning of dirt material containing sand particles, for example, as found on automobile carpets and the like as exemplified in U.S. Pat. Nos. 4,011,624, 2,999,263, 3,477,087, 3,903,564 and 3,303,498. These devices are designed in various sizes, shapes and weights according to their purpose and for those susceptible of use within the purpose of the present invention, there are disadvantages in the versatility to reach confined areas and in the ease of handling and balance relative to muscular fatigue. For those which require a cord attachment to a source of power there is a limitation of area of use and for those which have rechargeable batteries there is a relatively short limited running time so such devices are unusable while recharging is taking place. It is the purpose of this invention to overcome the disadvantages noted, and others as may appear, and to provide a cordless vacuum brush with improved design features directed to construction, versatility in use and ease in handling.

One of the important objects herein is to provide a portable electric battery operated cordless vacuum brush having a vacuum assembly and a removably attached handle assembly in which the batteries and a battery charger are encased so that the handle assembly can be removed for the purpose of charging the batteries and which permits the brush to be operated by a spare handle assembly while the other is being charged.

Another object is to provide a cordless vacuum brush of the above class in which the handle assembly is provided with an integral fold-out endcap having a connector plug for attachment to an electric outlet.

A further object herein is to provide a cordless vacuum brush as characterized that includes an elongated brush head selectively attachable to the vacuum assembly in a position transverse to the longitudinal axis of the entire device for general use or endwise in alignment with such axis for easy insertion into confined areas.

A further object herein is to provide a device as characterized in which the brush head is provided with means for flexibility of movement relative to the vacuum assembly so that it does not have to be held or operated at any fixed angular orientation relative to the surface being dusted.

Still another object is to provide a cordless vacuum brush of the above class on which the handgrip portion of the handle is located at or near the center of gravity of the entire unit to minimize the muscular effort required to use this device.

A still further object is to provide this device with a switch permitting either momentary or continuous operation.

SUMMARY

In accordance with this invention, a cordless vacuum brush includes a forward vacuum assembly containing a motor, fan, a dust trap and rearward elongated hollow handle assembly containing a plurality of battery cells connected in series for operating the motor and a built-in battery charger. The rear or free end of the handle assembly is equipped with an endcap having a fold-out connector or plug for plugging into and 120 volt AC outlet. The handle assembly is detachably secured to the vacuum assembly so that it can be removed for charging the batteries and when attached to an electrical wall outlet will hang straight down therefrom. A generally rectangular flat elongated brush head with a hollow interior and peripheral depending soft, pliable bristles includes means for flexibility of movement relative to the vacuum assembly so that it does not have to be held or operated at any fixed angular orientation relative to the surface being dusted and is also designed for orientation either transverse to the longitudinal axis of this device for general use or endwise in alignment with such axis for insertion into confined areas. The swing joint component is spring loaded and biased to restore the brush to longitudinal alignment. A switch is provided to allow momentary or continuous operation and with the availability of a spare handle assembly, the operating time for this device can be indefinite by interchanging such assemblies when necessary.

The foregoing objects and such further objects as may appear herein, or be hereinafter pointed out, together with advantages of this invention will be more fully discussed and developed in the more detailed description of the accompanying drawings.

DESCRIPTION OF THE PREFERRED EMBODIMENTS

Figures 1, 2:
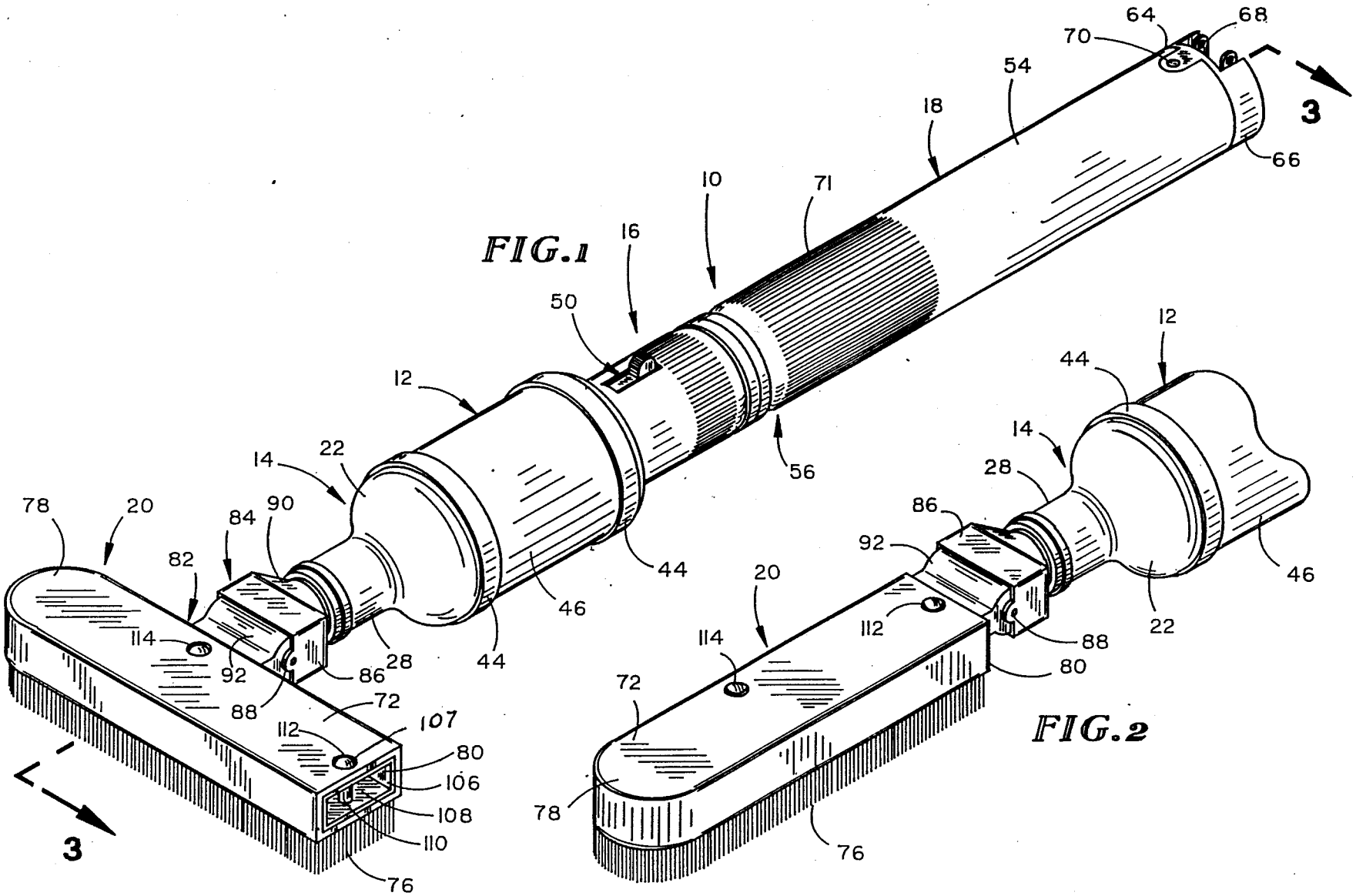
FIG. 1 is a perspective view of a cordless vacuum brush according to the present invention showing one position of orientation of the brush head assembly.
FIG. 2 is a fragmentary perspective view of the brush head assembly portion of this device showing an adjustable position of orientation therefor.

Referring to the drawings, this new cordless vacuum brush is designated by the numeral 10 as best seen in FIG. 1 and includes generally a vacuum assembly 12, defining a forward end 14 and a rearward end 16, a handle assembly 18 detachably secured to end 16 of assembly 12 and a brush head assembly 20 detachably secured to end 14 of assembly 12, all of which is more particularly described as follows.

Vacuum assembly 12 includes the front end cap 22 providing chamber 24 for the suction fan 26 and is reduced at its forward end to provide the tubular pickup end 28. The rear wall 30 of cap 22 is apertured 32 at one or more places about its periphery. A tubular housing 34 axially aligned with wall 30 at one end and forming end 16 at the other end is secured by the rear end cap 36 having the O-ring 38 as shown. An electric motor 40 is suitably secured to wall 30 within housing 34 and operably connected to fan 26 in a well known manner.

Figure 3:
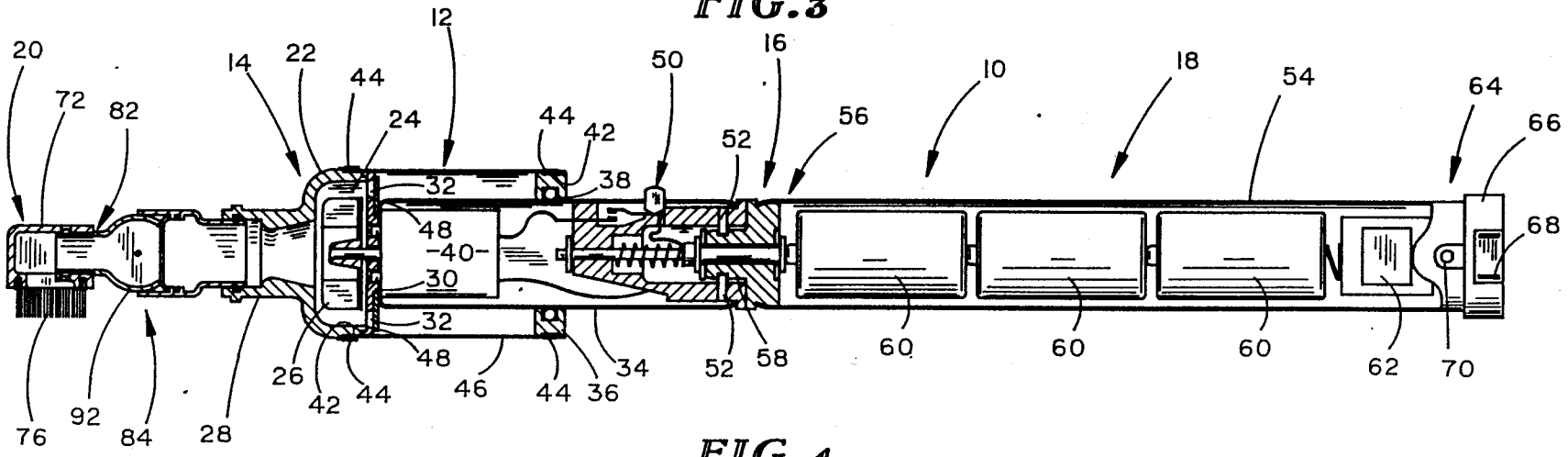
FIG. 3 is a longitudinal cross sectional view taken on the line 3—3 of FIG. 1.

The periphery of end caps 22, 36 are grooved 42 to receive self-locking flexible straps 44 of Nylon or the like for securing the dust trap sleeve 46 as best seen in FIG. 3. Sleeve 46 is preferably of a suitable tight weave fabric to prevent the escape of dust but open enough to allow the flow of air. It will be appreciated that apertures 32 permit air flow communication between chamber 24 and the interior of the dust trap sleeve 46 and such apertures are covered by flexible flaps 48 to prevent back flow of dust out of trap 46. In operation, the positive pressure produced by fan 26 causes flaps 48 to flex away from apertures 32 and permit dust laden air to flow freely into trap 46.

Figure 7:
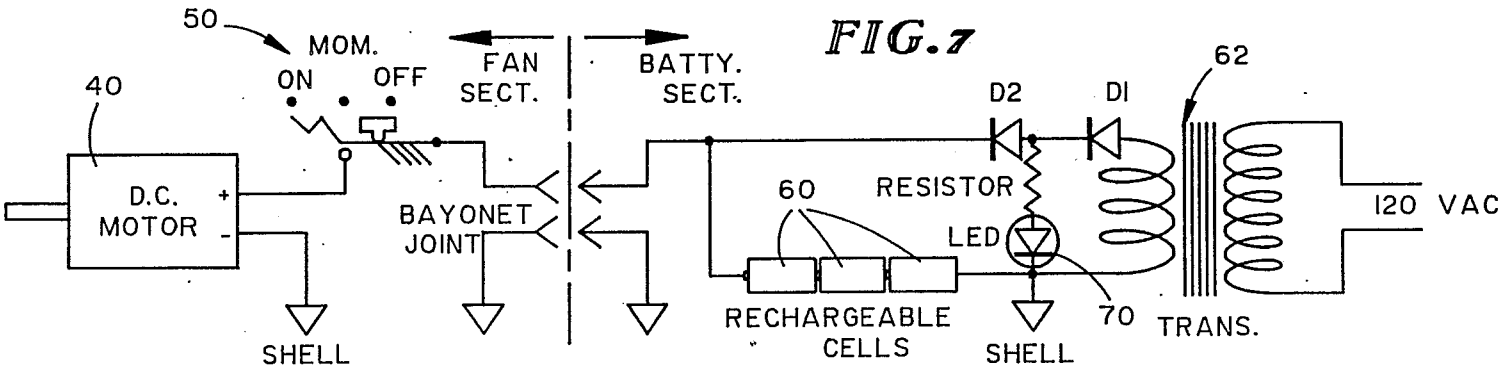
FIG. 7 is a schematic wiring diagram of the circuitry used with this invention.

End 16 of housing 34 contains the spring loaded switch assembly 50 for momentary and continuous operation as seen in FIGS. 3 and 7 and such end is also provided with opposed pins 52 for a bayonet attachment to assembly 18 as will later appear.

Assembly 18 serves as the handle or hand gripping portion of device 10 and includes an elongated, preferably tubular, housing 54 provided at its forward end 56 with the notched projection 58 for removably bayonet type attachment with pins 52 at end 16 of assembly 12 as seen in FIG. 3. Housing 54 contains a plurality of removable, rechargeable and replaceable battery cells 60 connected in series without wiring and without clamps or retainers which are operably connected to motor 40 at end 56 and to a battery charger 62 at end portion 64 as seen in FIGS. 3 and 7. End 64 is also equipped with an end cap 66 having a fold-out connector plug 68 for attachment to any conventional 120 volt AC outlet. Also provided at end 64 is the LED (light emitting diode) indicator 70 which lights up when assembly 18 is plugged in for recharging if charger 62 is operative. When not on charge, diode D2 (FIG. 7) blocks battery current to indicator 70 so it will not be illuminated. The hand grip portion 71 of handle assembly 18 is located at or near the center of gravity of the entire unit 10 and thus minimizes the muscular effort required to use this device.

The brush head assembly 20 includes a generally flat elongated brush head 72 with a hollow interior 74, peripheral depending soft, pliable bristles 76, a closed exteriorly rounded end 78 and an open end 80. Intermediate ends 78 and 80, and on one side of head 72, an opening 82 is provided in like size as opening 80 (FIG. 3, 4). By this arrangement as will be referred to later in more detail, head 72 can be easily and quickly mounted broadside to assembly 12 at opening 82 (FIG. 1) for general use or endwise at opening 80 (FIG. 2) for insertion into confined areas which is a feature absent from similar devices.

Figure 4:
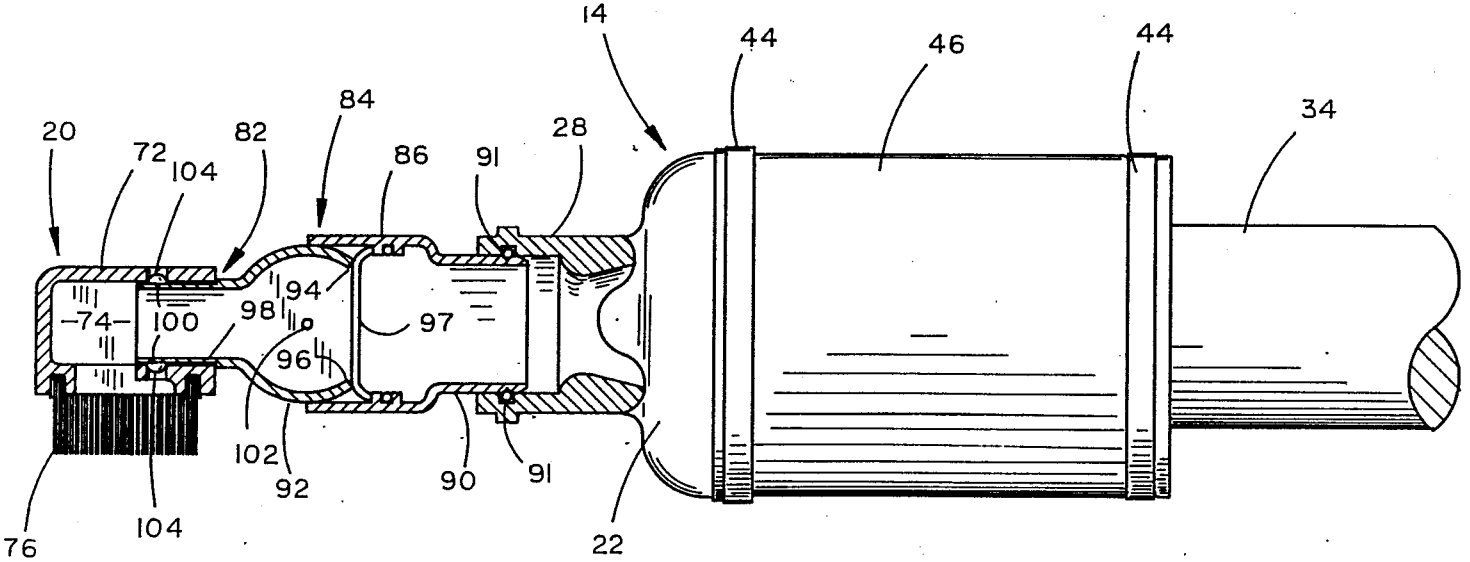
FIG. 4 is an enlarged fragmentary elevational view, partially in section, showing the swing joint mounting of the brush head assembly to the vacuum assembly.
Figure 5:
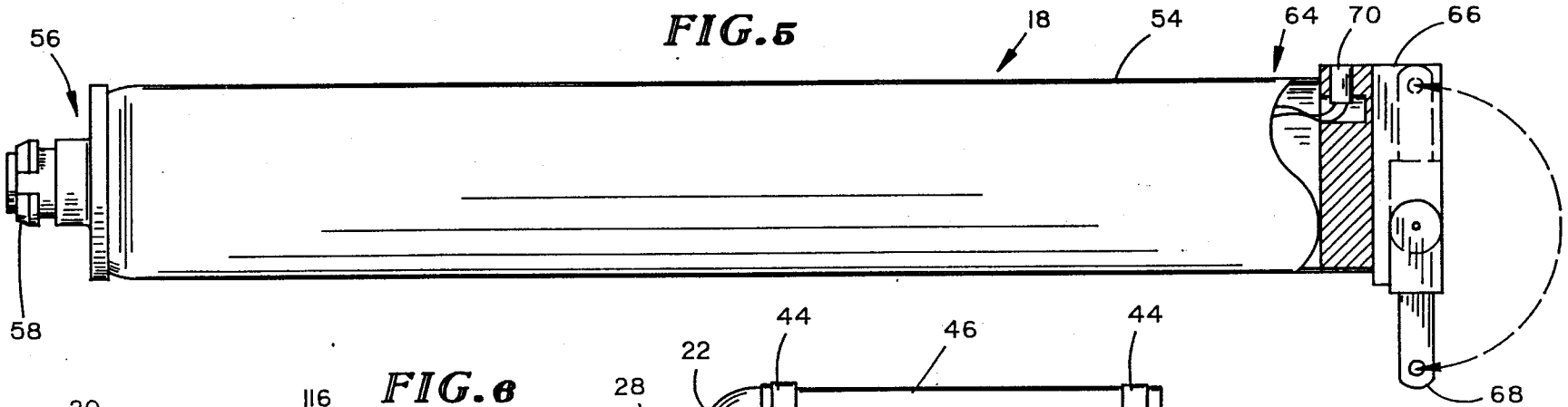
FIG. 5 is an enlarged elevation view of the handle assembly, partially in section, showing the fold-out endcap with connector plug for attachment to a 120 volt AC outlet.

For mounting brush head assembly 20 to the vacuum assembly 12 it is deemed desirable to provide assembly 20 with some degree of versatility of movement to obviate the need for holding device 10 at any fixed angular orientation relative to the surface being dusted which I have observed as a disadvantage in other devices of this type. For this purpose, I have designed the swivel or swing joint connection assembly 84 as best seen in FIGS. 1 and 4. Assembly 84 includes a box shaped housing 86 open at the front with opposed apertured ears 88 on the front side edges and with the rear formed with a short tubular extension 90 for a snap fit connection 91 to the pickup end 28 of assembly 12. A swing or swivel member, preferably of plastic material, comprises a truncated drum 92 defining edges 94, 96 engageable with spring 97 in housing 86 and the integral protruding square tubular nose 98 which has the opposed exterior beads 100. Spring 97 has the effect of tending to restore drum 92 to a straight position. The opposed sides of drum 92 have beads 102 by which drum 92 can be snap-fitted to housing 86 with beads 102 seating in the respective ears 88 to afford vertical movement of drum 92 relative to housing 86. The brush head 72 is selectively mounted to nose 98 either at opening 80 or 82 (FIGS. 1, 2) and for this purpose, the upper and lower interior surfaces forming said openings are provided with opposed recesses 104 for a friction fit with beads 100 as best seen in FIG. 4. A removable box-like closure plug 106 is provided for whichever of openings 80, 82 are not attached to nose 98 and is releasably held in place by the external bead 107 that will seat in either hole 112 or 114. Plug 106 is recessed 108 for manual access to an integral upstanding pin 110, of plastic or the like to facilitate its insertion or removal.

Figure 6:
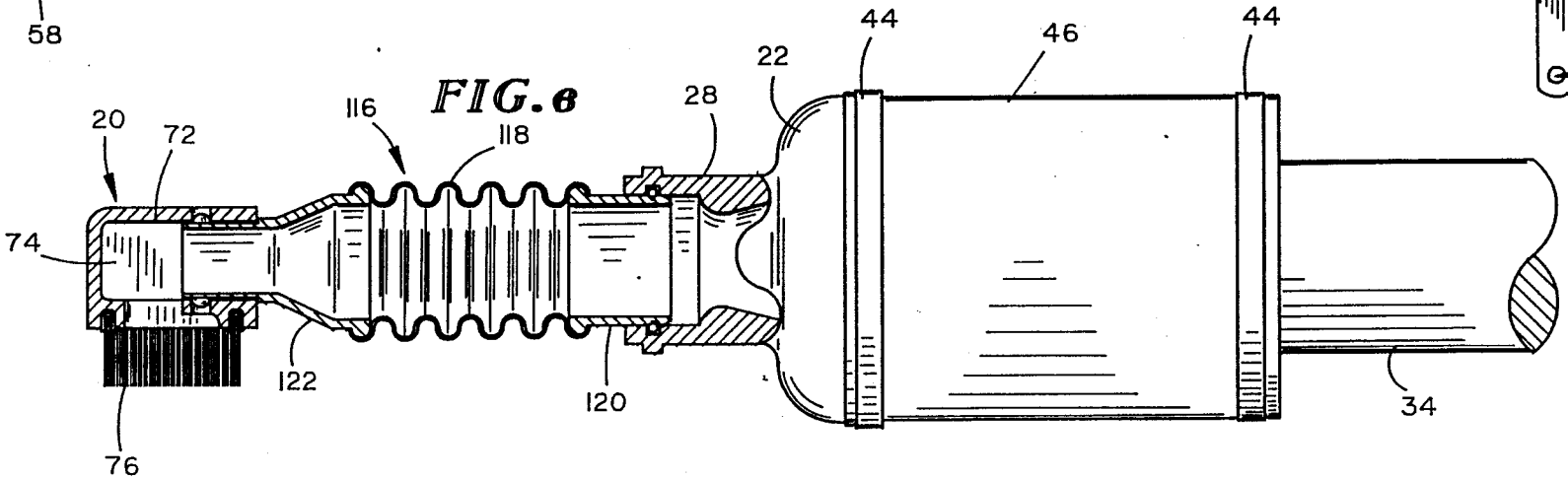
FIG. 6 is a view similar to FIG. 4 but showing a modified flexible attachment of the brush head assembly to the vacuum assembly.

In FIG. 6 there is shown a flexible connector assembly 116 which can be used to couple the brush head assembly 20 to the vacuum assembly 12 in place of the swing joint assembly 84 described above to provide a greater versatility of movement of the brush, if desired. Assembly 116 includes a short length of corrugated plastic tubing 118 rotatably attached at one end to fitting 120 for a slip-fit connection with end 28 of cap 22 as shown and attached at the other end to fitting 122 for a slip-fit connection to either openings 80, 82 in brush head 72 as previously described for drum 92.

It will be appreciated from the above description that device 10 includes many improved features of contruction affording versatility in use, in handling and in maintenance and in economy of manufacture. The location of the handgrip 71 on handle assembly 18 at or near the center of gravity of the entire device 10 minimizes the muscular effort to use device 10 and this is especially meaningful for persons with arthritic hands and/or wrists. The encasement of the removable and replaceable battery cells 60, battery charger 62 and fold-out connector plug 68 in the detachable handle assembly 18 permits removable of one assembly 18 with discharged batteries and replacement by a spare assembly 18 with charged batteries so that the operating time can be indefinite. In addition, because the batteries are easily replaceable, only one assembly 18 is actually required to achieve an indeterminate running time. It will also be apparent that when handle assembly 18 is removed, it presents a component shorter and lighter in weight than the assembled unit 10 so that with the design of the end cap connector 68, it can hang straight down from any convenient outlet when being charged. Another advantage of the detachability of assembly 18 is that, if desired, it can be placed under lock and key to prevent unauthorized use or misuse. It will also be noted that construction of handle assembly 18 is simplified by not requiring separate clamps or retainers for the battery cells 60 arranged in series as described with a resulting economy in manufacture. In addition, with switch means 50 provided for both momentary and continuous operation, the handle assembly 18 lends itself for use with an extension handle (not shown) that is a well known expedient.

A particular advantage and improvement in device 10 resides in the flexibility of connection of the brush head 72 to assembly 12 so that the handgrip 71 can be held at an angle to the surface appropriate to conditions and is not required to be used at a fixed angle of orientation. A further important advantage and improvement is the capability of the elongated brush head 72 to be selectively oriented broadside for general use and endwise for insertion into confined areas which is a feature not present in similar devices.

Device 10 as described is designed particularly for removing dirt particles generally having the consistency of talcum powder and is intended for use solely in the housekeeping task call "dusting". Dust particles are electrostatically attracted to most surfaces and the use of a brush to break them away greatly decreases the amount of suction required as compared with vacuum cleaners designed to pick up heavier particles. For this reason, the power requirements for device 10 are considerably less than for vacuum cleaning devices with the result that the relative running time between battery charges is considerably greater for device 10 as compared with conventional portable vacuum cleaners. Accordingly, in view of the foregoing, it is thought a full understanding of the construction and operation of this invention will be had and the advantages of the same will be appreciated.

I claim:

1. A cordless battery operated electric portable vacuum brush, comprising:

a vacuum assembly including a dust trap, a motor operated fan and a brush head for picking up dust particles of the approximate consistency of talcum powder, a handle assembly containing one or more rechargeable batteries and a battery charger operably connected thereto, said handle assembly being detachably secured to said vacuum assembly so that it can be removed therefrom for charging said battery, switch means for controlling connection of said battery to said motor, said brush head being of an elongated configuration with a hollow interior, open bottom and peripheral soft, depending bristles, and means to selectively mount said brush head to said vacuum assembly in a broadside orientation therewith for general use and in an endwise orientation therewith to facilitate insertion into confined areas.

2. A device as defined in claim 1 including a connector plug for attachment to an electrical outlet mounted in said handle assembly in operable connection to said charger.

3. A device as defined in claim 2, including:

said connector plug being normally disposed within the confines of said handle assembly, and means for folding out said connector plug for operable engagement with an electrical outlet.

4. A device as defined in claim 1 including means for movably attaching said brush head to said vacuum assembly for angular freedom of movement relative thereto.

5. A device as defined in claim 1, including:

said vacuum assembly defining a dust receiving chamber with an air port in communication with said dust trap, and a flexible flat disposed to close said air port to prevent back flow of dust from said dust trap but which flexes to an open position from pressure from said fan when operating to permit the free flow of dust laden air into said dust trap.

6. A device as defined in claim 5 including said dust trap being of a foraminous fabric weave adapted to prevent the escape of dust but allowing the passage of air to the atmosphere.

7. A device as defined in claim 1, including:

said handle assembly having an elongated hollow configuration adapted to receive a plurality of batteries in linear orientation for connection without clamps or retainers, and a handgrip portion located at or near the center of gravity of the entire device to minimize the muscular effort needed to use said device.

8. A device as defined in claim 1 including said switch means being constructed to provide for selective momentary and continuous operation of said motor.

9. A cordless battery operated electric portable vacuum brush, comprising:

a vacuum assembly including a dust receiving chamber, a dust pickup end, a foraminous dust trap sleeve for preventing the escape of dust but allowing the passage of air to the atmosphere, and an electrical switch means, a movable joint mounting detachably secured to said pickup end, a brush head with soft bristles detachable secured to said movable joint mounting, an elongated hollow handle for containing a plurality of rechargeable batteries in linear orientation for connection without clamps and retainers, and a battery charger, said handle being detachably secured to said vacuum assembly so that it can be removed therefrom for charging said batteries, means in the attachment of said handle to said vacuum assembly for connecting said switch means to said batteries and said motor, and an endcap on said handle carrying a connector plug for attachment to an electrical outlet.

10. A device as defined in claim 9, including:

said connector plug being normally disposed within the confines of said endcap, and means for folding out said connector plug for operable engagement with an electrical outlet.

11. A device as defined in claim 9, including:

said brush head being generally and elongated housing with a hollow interior and open bottom, and means to selectively mount said brush head to said movable joint mount in a broadside orientation therewith for general use and in an endwise orientation therewith to facilitate insertion into confined areas.

12. A device as defined in claim 11 wherein the means for mounting said brush head to said movable joint mounting includes:

one end of said brush head being provided with an opening adapted for a slip fit connection to said movable joint mounting and a like opening provided at the longitudinal central portion on one side of said brush head, and a removable plug closure for insertion into whichever of said openings is not engaged with said movable joint mounting to avoid loss of suction in operation of said device.

13. A device as defined in claim 9, including:

air flow communication means between said dust chamber and said dust trap sleeve, and a flexible flap disposed to close said air flow communication means to prevent back flow of dust from said dust trap sleeve but which flexes to open position from pressure from said fan when operating to permit the free flow of dust laden air into said dust trap sleeve.

14. A device as defined in claim 9, including said switch means being constructed to provide for selective momentary and continuous operation of said motor.

15. A device as defined in claim 9 including a handgrip portion on said handle located at or near the center of gravity of the entire device to minimize the muscular effort needed to use said device.

16. A device as defined in claim 1, including:

complementary bayonet joint components on said vacuum assembly and said handle assembly for detachably connecting the same, and said bayonet joint components constructed and adapted to effect the connection of said switch means with said battery and said motor.

17. A device as defined in claim 9 wherein said means in the attachment of said handle to said vacuum assembly for connecting said switch means to said batteries and said motor includes complementary bayonet joint components on said vacuum assembly and said handle for connecting the same.

18. A cordless battery operated electric portable vacuum brush, comprising:

a vacuum assembly including a dust trap, a motor operated fan and a brush head for picking up dust particles of the approximate consistency of talcum powder, a handle assembly containing one or more rechargeable batteries and a battery charger operably connected thereto, said handle assembly being detachably secured to said vacuum assembly so that it can be removed therefrom for charging said battery, switch means for controlling connection of said battery to said motor, said handle assembly having an elongated hollow configuration adapted to receive a plurality of batteries in linear orientation for connection without clamps or retainers, and a handgrip portion located at or near the center of gravity of the entire device to minimize the muscular effort needed to use said device.

19. A device as defined in claim 18 including means for movably attaching said brush head to said vacuum assembly for augular freedom of movement relative thereto.

20. A device as defined in claim 18 including a connector plug for attachment to an electrical outlet mounted in said handle assembly in operable connection to said charger.

21. A device as defined in claim 20, including:

said connector plug being normally disposed within the confines of said handle assembly, and means for folding out said connector plug for operable engagement with an electrical outlet.

22. A cordless battery operated electric portable vacuum brush, comprising:

a vacuum assembly including a dust trap, a motor operated fan and a brush head for picking up dust particles of the approximately consistency of talcum powder, a handle assembly containing one or more rechargeable batteries and a battery charger operably connected thereto, said handle assembly being detachably secured to said vacuum assembly so that it can be removed therefrom for charging said battery, switch means for controlling connection of said battery to said motor, a connector plug for attachment to an electrical outlet mounted in said handle assembly in operable connection to said charger, said connector plug being normally disposed within the confines of said handle assembly, and means for folding out said connector plug for operable engagement with an electrical outlet.

23. A device as defined in claim 22, including:

and endcap on said handle assembly, and said connector plug being disposed within the confines of said encap.

* * * * *